US006719519B2

(12) United States Patent
Liehs

(10) Patent No.: US 6,719,519 B2
(45) Date of Patent: Apr. 13, 2004

(54) APPARATUS FOR LOADING PACKING CARRIERS INTO A PACKAGING MACHINE

(75) Inventor: Bernard Claus Liehs, Waterloo (CA)

(73) Assignee: International Machinery and Guarding Systems Inc., Waterloo (CA)

( * ) Notice: Subject to any disclaimer, the term of this patent is extended or adjusted under 35 U.S.C. 154(b) by 0 days.

(21) Appl. No.: 10/310,026

(22) Filed: Dec. 5, 2002

(65) Prior Publication Data

US 2003/0103838 A1 Jun. 5, 2003

(30) Foreign Application Priority Data

Dec. 5, 2001 (GB) ..... 0129115

(51) Int. Cl.[7] ..... B65G 65/23
(52) U.S. Cl. ..... 414/419; 414/403; 414/422
(58) Field of Search ..... 414/403, 419, 414/422, 404

(56) References Cited

U.S. PATENT DOCUMENTS 6,213,707 B1 * 4/2001 Liehs et al. ..... 414/421

* cited by examiner

*Primary Examiner*—Khoi H. Tran
(74) *Attorney, Agent, or Firm*—Anthony Asquith & Co.

(57) ABSTRACT

For automatic unloading of soft-drink pack carriers form boxes, and depositing same into the carrier-magazine of a packaging machine. The carrier box is loaded into a bucket, from a full-box-conveyor. The bucket is pivotable, and is overturned to enable the box to be extracted from the bucket, leaving the carriers inside. The bucket is pivoted in a cradle, and the cradle is carried in a bucket-elevator, and the bucket can undergo up/down movements on the elevator. Because of the elevator, the box conveyors can be overhead, out of the way of the magazine into which the carriers are to be transferred.

18 Claims, 9 Drawing Sheets

APPARATUS FOR LOADING PACKING CARRIERS INTO A PACKAGING MACHINE

The present invention represents a development of the technology described in patent publication U.S. Pat. No. 6,213,707, to which attention is directed. Many of the structures and components as described herein are explained more fully in that publication.

BACKGROUND TO THE INVENTION

The apparatus of the present invention is intended for use with certain types of packaging machines, being especially packaging machines for packaging e.g soft-drink cans into cardboard carriers.

These packaging machines have a carrier magazine, in which the carriers are stacked in an unopened condition. The packaging machine is arranged to pick the cardboard carriers off the magazine one by one, to unfold and open up the picked carrier so that the carrier presents e.g six receptacles, then to place the opened six-pack carrier on a conveyor, then to lower six soft drink cans into the six receptacles, and then to convey the six packs away for sale.

The packaging machine with which the apparatus of the present invention is mainly intended for use includes also a carrier-picker, which functions to pick the next carrier from the magazine. The carrier-picker serves to pick the as-yet-unopened carriers out of the magazine on a one-and-only-one basis. The designer has to be careful to ensure that only one carrier is picked, since picking either no carrier, or two carriers, can be highly disruptive to the operation of the packaging machine.

The accuracy with which the carrier-picker carries out its one-and-only-one function depends not only on the structure of the carrier-picker, but also on the manner in which the magazine presents the carriers to the carrier-picker. Simply providing that the magazine does not run out of carriers during operation is not enough: the designer should ensure that the carriers in the magazine are urged towards the carrier-picker always with the same force, or at least approximately the same force. If the stack of carriers in the magazine were pressed hard against the carrier-picker one minute, and then pressed only lightly towards the carrier-picker the next minute, that might well lead to erratic performance of the carrier-picker, and to the one-and-only-one function being compromised.

The apparatus of the present invention has, as a main function, the automatic replenishment of the carrier magazine with fresh carriers. The carriers are shipped and delivered to the factory in which the packaging machine is located, in cardboard shipping-boxes, and it is one of the functions of the present apparatus to extract the fresh carriers from the shipping boxes, and to insert them into the magazine.

It is an aim of the invention to accomplish the automatic replenishment in a manner that permits the magazine to continue to maintain an approximately-constant force on the carrier picker, during replenishment. It would not be acceptable for the replenishment apparatus to require the packaging machine to be stopped, in order to permit routine replenishment.

It is also an aim of the invention to provide an apparatus which can be adapted for use with a number of different kinds of magazines and packaging machines.

It is also an aim to provide an apparatus that, having been fitted to a particular machine, can be adjusted for different requirements. For example, the packaging machine may be set up to package six-packs of beer bottles on Monday, and to package twelve-packs on Tuesday. Not only are the carriers different, but Tuesday's carriers might also be orientated, in their shipping boxes, upside-down with respect to Monday's.

It is also an aim to provide an apparatus which will enable trouble-free replenishment of carrier magazines over a long service period. Since factory machinery can be dangerous for operatives and others, it is also an aim to provide an apparatus in which the possibility of injuries to workers (and damage to the apparatus) is minimised.

GENERAL FEATURES OF THE INVENTION

In the apparatus shown in U.S. Pat. No. 6,213,707, the shipping box suction head was conveyed on a travelling track, and the movements of the bucket included only pivoting about a fixed pivot. In the present apparatus, the bucket not only pivots, but travels vertically, on a bucket-elevator. The suction-head may also be on an elevator, but, as will be described, the required motions of the suction-head can now be accommodated by a swing-lever about a fixed pivot axis.

In the present apparatus, the carriers are extracted from the box by pulling the box straight up out of the bucket. In the present apparatus, preferably the box is held steady by the suction head, and the bucket is lowered in the elevator, to achieve the linear extraction motion relatively between the box and the bucket. The bucket moves downwards in a linear motion, preferably with no arcuate component. The movement of the bucket on the elevator is vertical, or nearly vertical.

The inclusion of the bucket-elevator means that the conveyor for the incoming full boxes of carriers, and the conveyor for the outgoing empty boxes, are well above the height of the magazine. Generally, the magazine is at e.g waist height, since the magazine is a critical component that needs to be carefully set up by the assembly-line setter. Of course, the conveyors also are subject to being adjusted and maintained, but it is recognised as preferable not to compromise the access and space around the magazine, and this preference can be accommodated when the conveyors can be positioned well above the magazine.

In the present apparatus, the full-box-conveyor does not need to be within arc-swing distance of the magazine, as was the case in '707. The empty-box-conveyor does have to be within arc-swing distance of the elevator, but that is not a very demanding restriction, by comparison.

Of course, the box conveyors should not be too far up above the magazine. The carriers go through the carrier-picker at a rate of, say, one per second. There may be as few as fifty carriers in a box, which means the cycle time for replenishing the magazine with fresh carriers has to be accomplished well within fifty seconds. But having the bucket travel through a vertical height of a meter or two is easily accommodated within the allowable cycle time.

The carrier-picker at the end of the magazine of carriers must pick carriers from the magazine on a one-and-only-one basis. The accuracy of the carrier-picker is affected by the force with which the carriers are pressed against the carrier-picker. That force should be kept reasonably constant—and it is not acceptable for the carrier picker to stop picking carriers from the magazine while the magazine is being replenished. The row of carriers is biassed towards the carrier picker by means of weights, or a pneumatic ram, or the equivalent. But the biassing device has to be withdrawn during replenishment. As noted in U.S. Pat. No. 6,213,707, there is enough compressive resilience in the row of carriers on the magazine to keep the carriers pressing constantly against the carrier picker, even though the biassing device has been withdrawn, if hooks or fingers are provided to stop the row of carriers from easing away from the carrier-picker.

The force with which the carriers press against the carrier-picker can be maintained more nearly constant, if the quantity of carriers per box is small. Thus, frequent transfers of a small number of carriers to the magazine is preferred over the less frequent transfer of a larger number. It is preferred that the boxes should contain, typically, no more than about two hundred carriers—because then the difference in the magazine, between "just filled", and "filling now required", might be too much, whereby the carrier picker might start to function erratically. On the other hand, the boxes should not contain less than about fifty, or cycle times become too rapid and jerky for the kinds of motions required.

Whatever the number of carriers in a box, preferably the whole quantity should be transferred to the magazine in one go. It can be awkward to handle the carriers if the quantity has to be split after taking the stack out of its shipping box.

The arrangement of the apparatus as described herein permits the pivot axis of the bucket to run through the centre of gravity of the loaded bucket, or close to it. This keeps centrifugal forces on the contents of the bucket to a minimum, permitting fast motions. It also means that the arc-swing of the bucket about its axis is minimised, which is useful in tight spaces. It also means that no counterweights are needed for the bucket.

DETAILED DESCRIPTION OF PREFERRED EMBODIMENTS

By way of further explanation of the invention, exemplary embodiments of the invention will now be described with reference to the accompanying drawings, in which.

Figure 1:
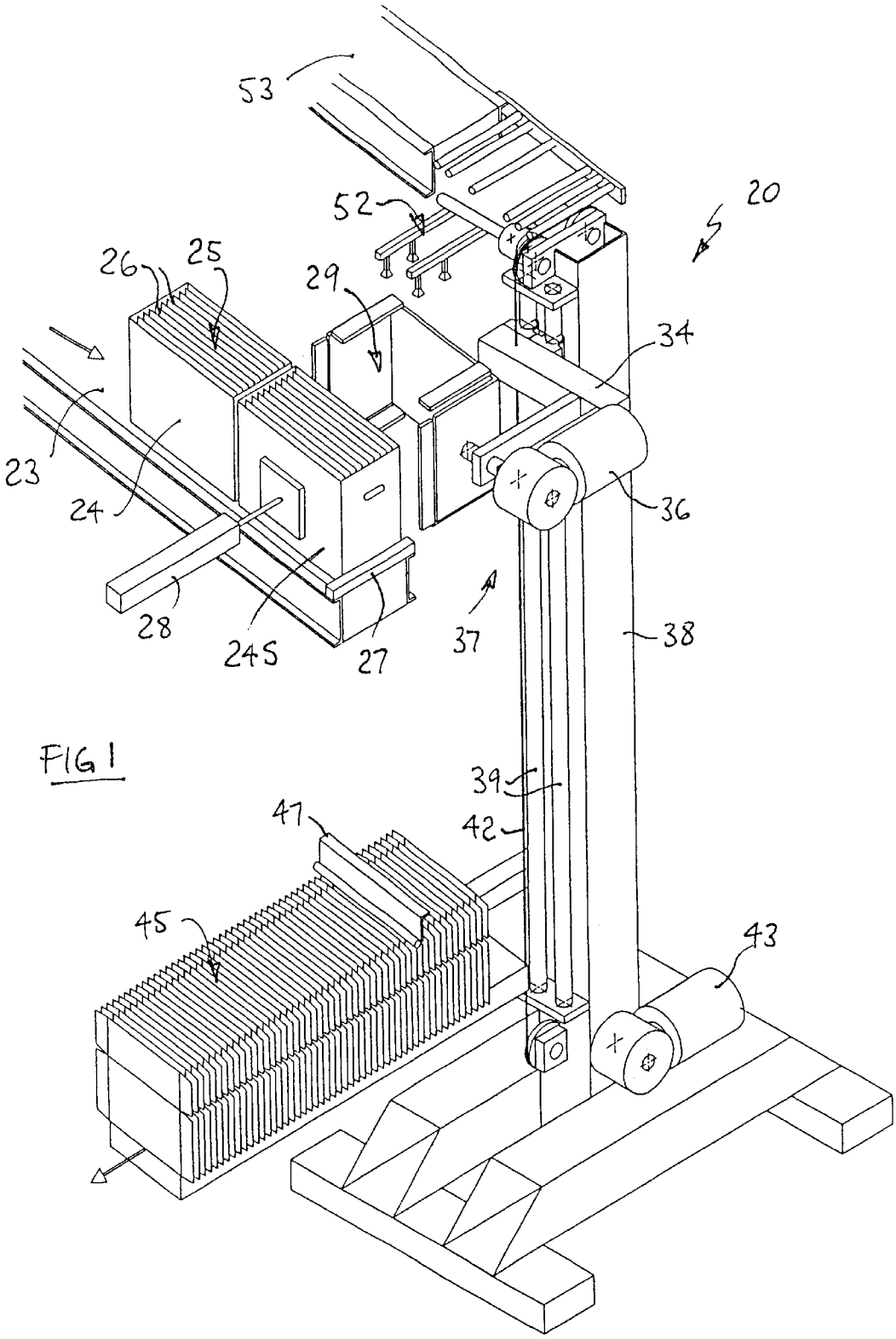
FIG. 1 is a diagrammatic pictorial view of an apparatus that embodies the invention.
Figure 6:
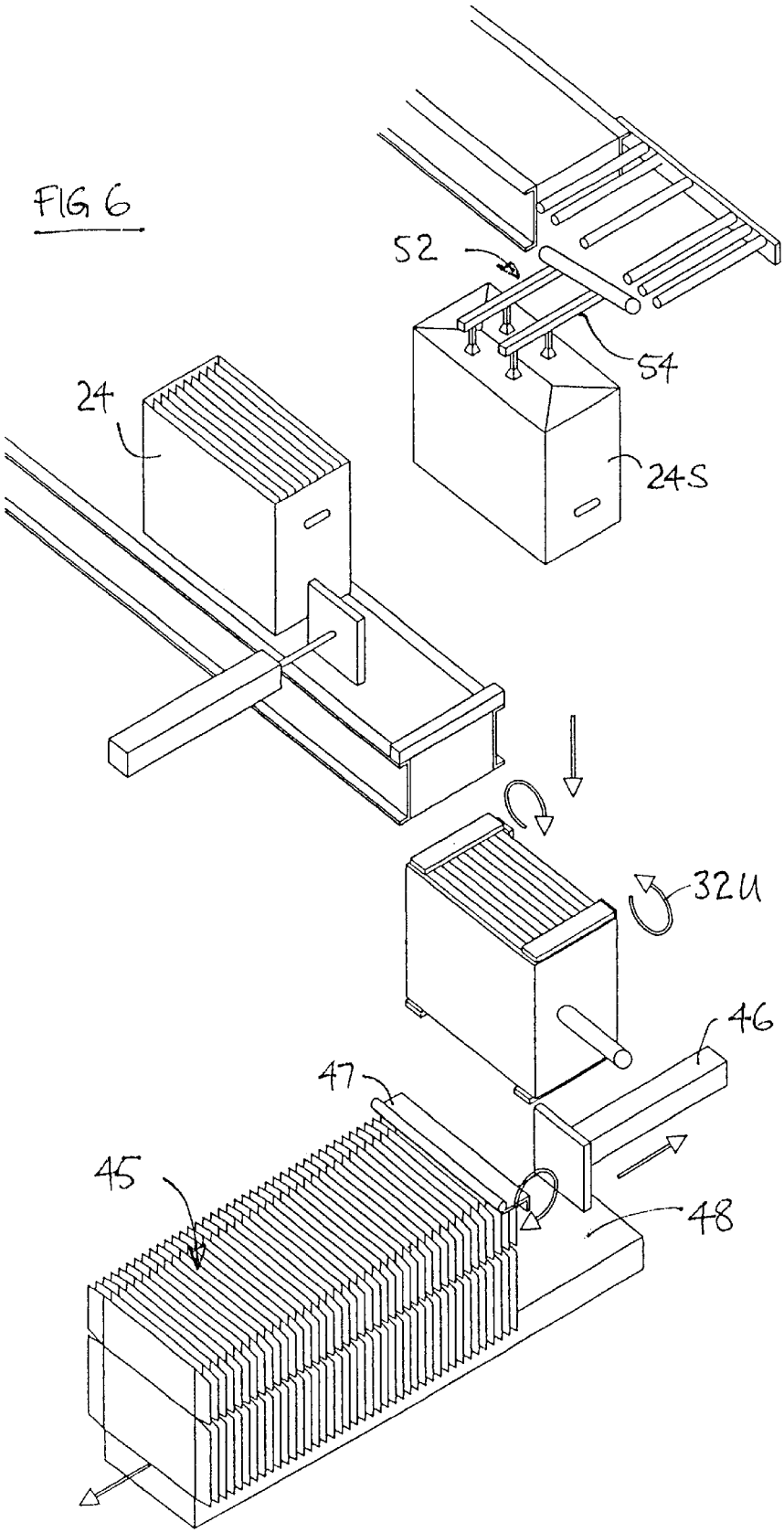
FIG. 6 is the same view as FIG. 2, but shows the apparatus at a later stage of operation.
Figure 6A:
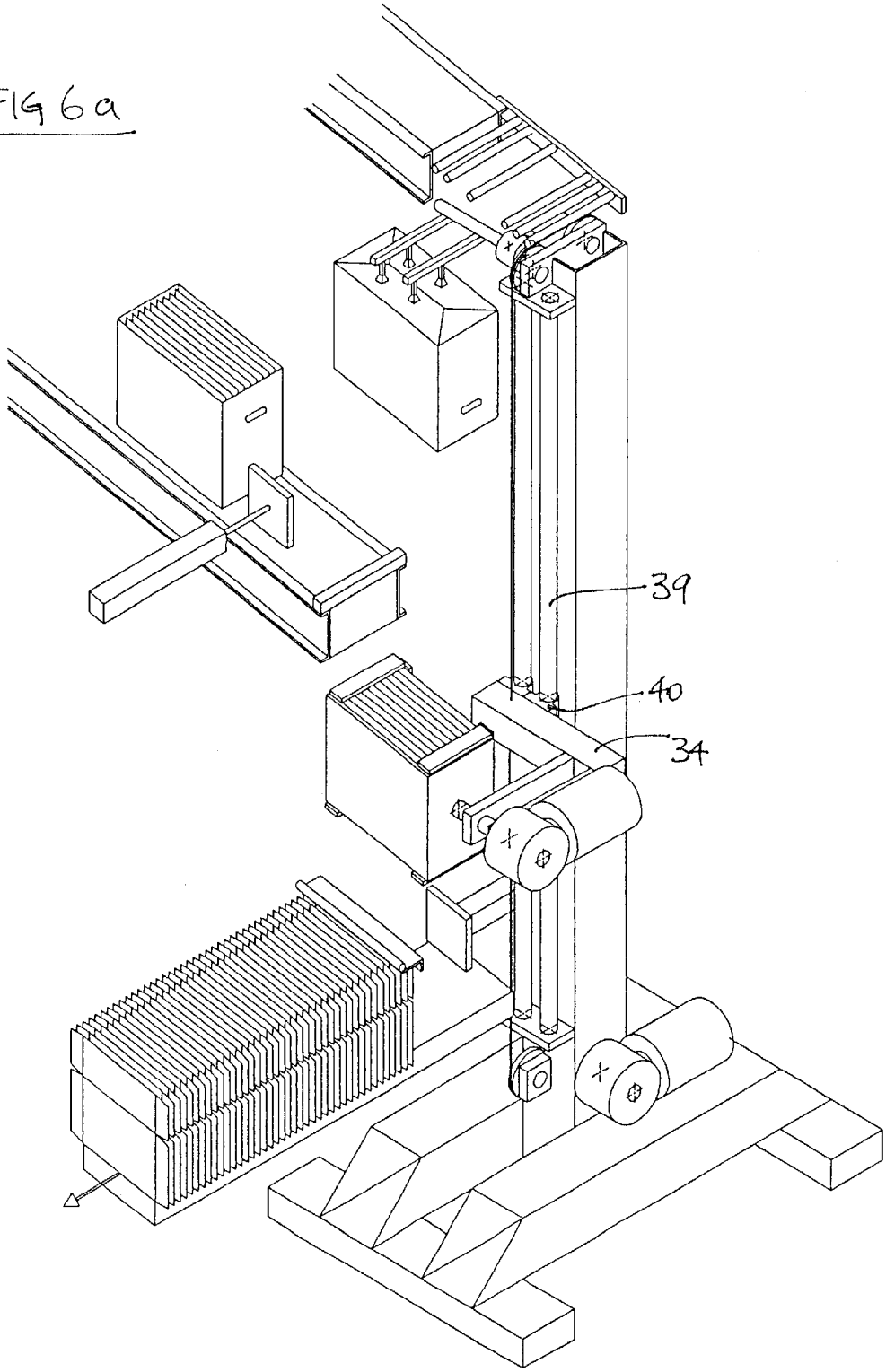

FIG. 6*a* is the same view as FIG. 1, but shows the apparatus at the same stage as FIG. 6.

Figure 7:
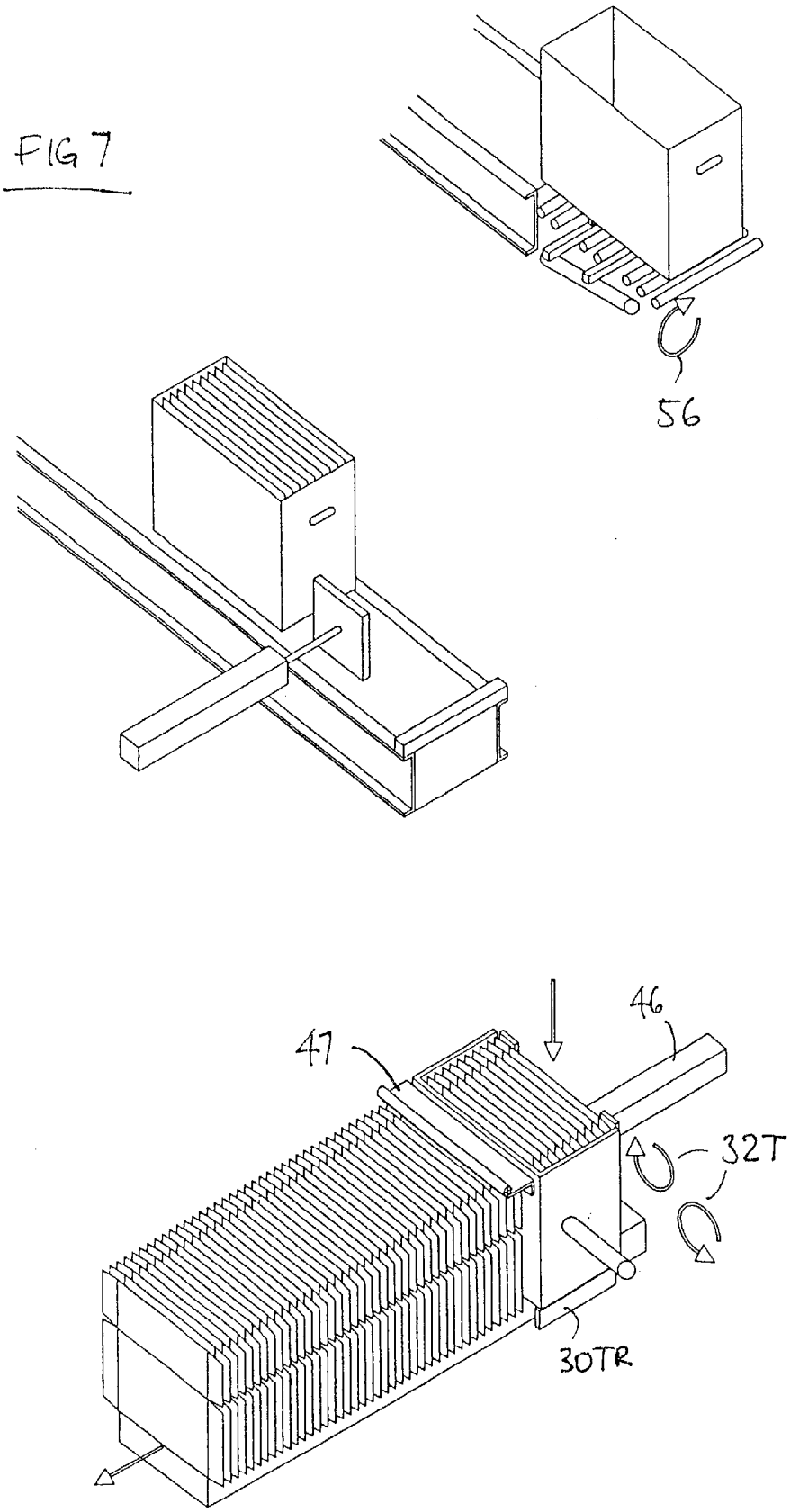

FIG. 7 is the same view as FIG. 1, but shows the apparatus at a later stage of operation.

Figure 8:
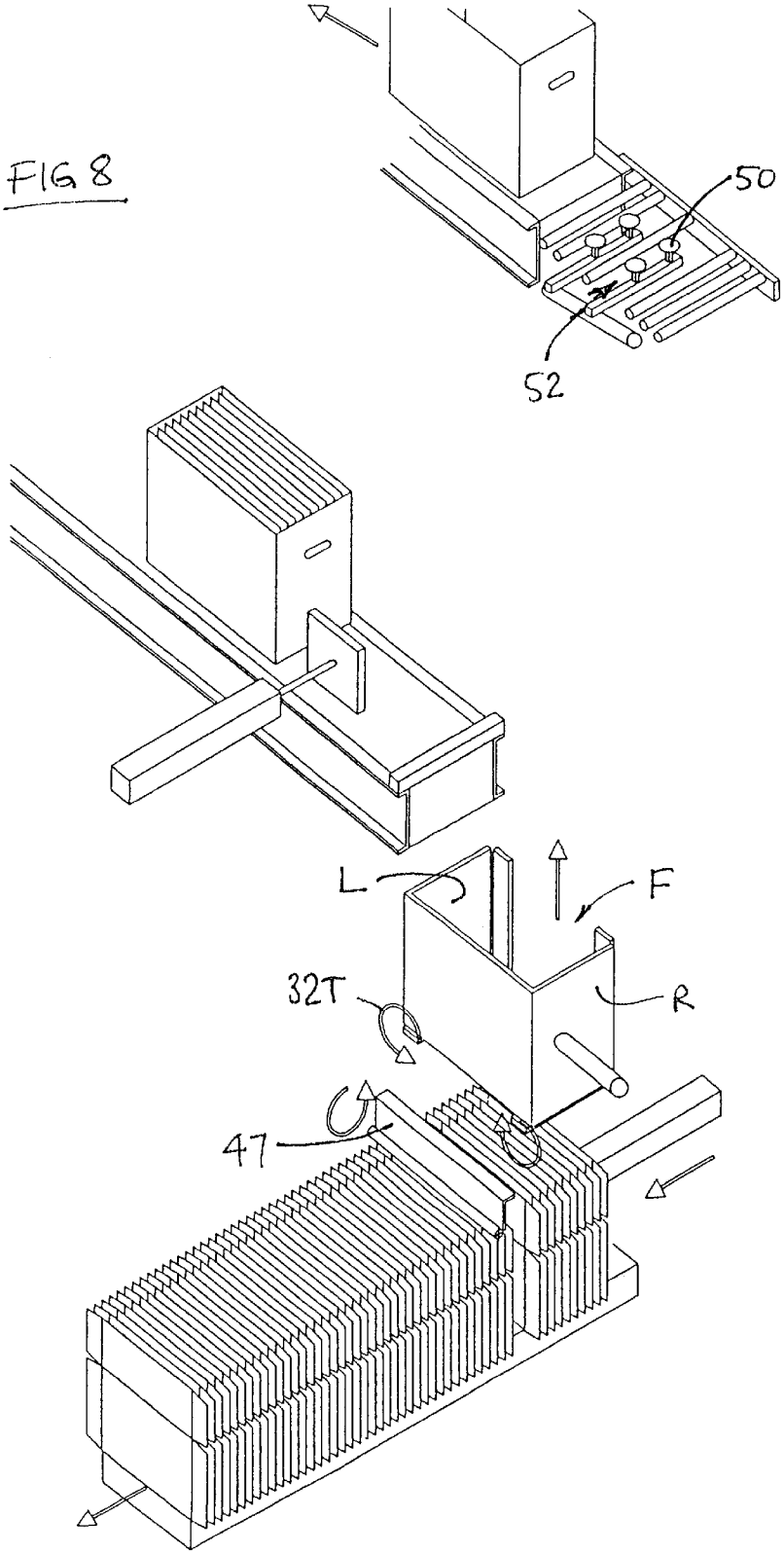

FIG. 8 is the same view as FIG. 1, but shows the apparatus at a later stage of operation.

Figure 9:
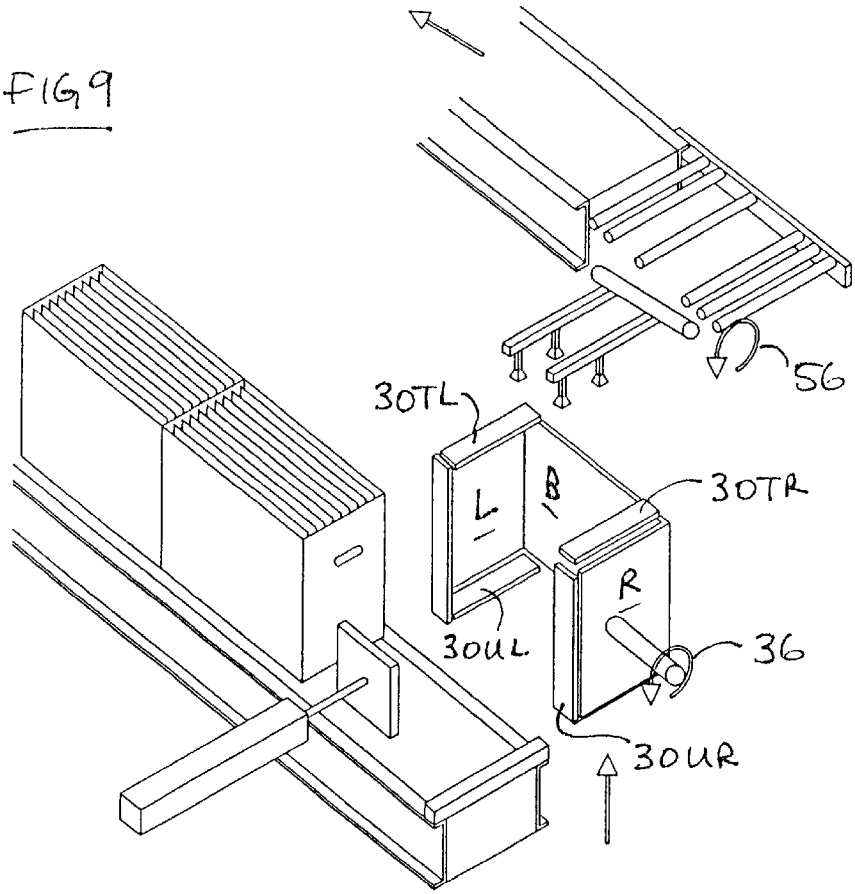
Figure 9:
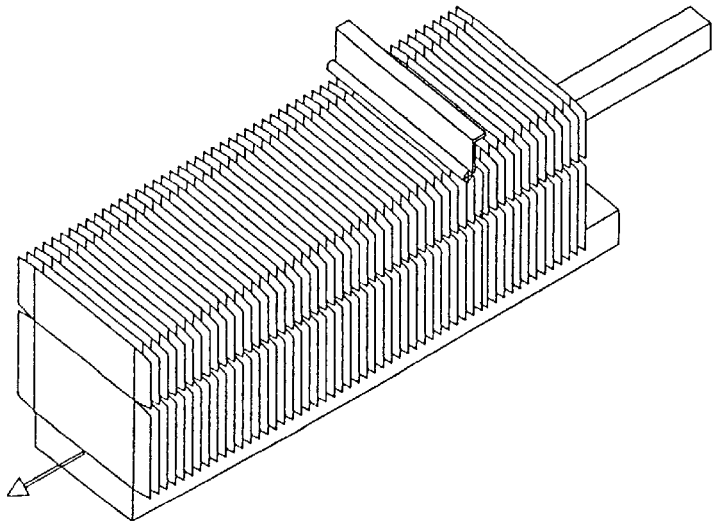

FIG. 9 is the same view as FIG. 1, but shows the apparatus at a later stage of operation.

Figure 10:
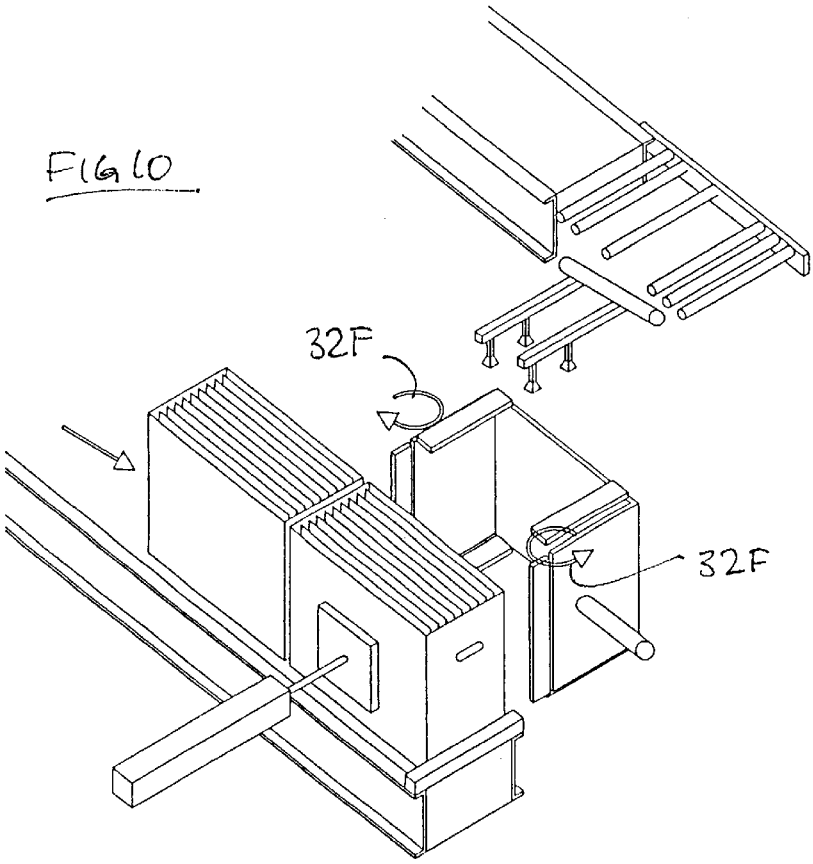
Figure 10:
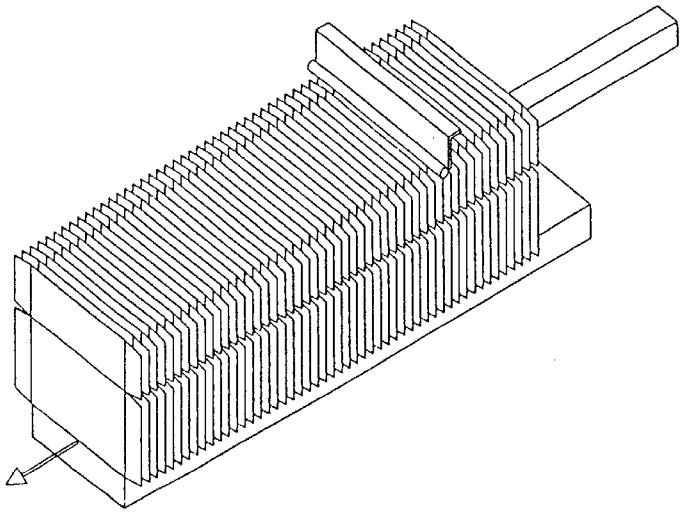

FIG. 10 is the same view as FIG. 1, but shows the apparatus at a later stage of operation.

The apparatuses shown in the accompanying drawings and described below are examples which embody the invention. It should be noted that the scope of the invention is defined by the accompanying claims, and not necessarily by specific features of exemplary embodiments.

As mentioned, attention is directed to U.S. Pat. No. 6,213,707. The apparatus shown in the accompanying drawings is intended to be used for similar purposes to those of the apparatus depicted therein.

The apparatus 20 includes a full-box-conveyor 23, on which are located dozens of boxes 24, each box containing a respective batch 25 of cardboard carriers 26. The senior box 24S rests against a stop 27 of the full-box-conveyor 23. The apparatus includes a box-motor, in the form of a ram 28, for driving the senior box 24S off the full-box-conveyor 23, and into a bucket 29.

The bucket 29 has six panels, being the front, back, left, right, top, and bottom panels. The orientation designations—front, back, left, right, top, bottom—are made from the viewpoint of an observer in the senior box 24S abutting the stop 27 on the full-box-conveyor 23, looking towards the bucket. In the following descriptions, the panels of the bucket are called by these same designations, even after the bucket 29 is moved and rotated;

The left panel L, the right panel R, and the back panel B of the bucket 29 are solid, in the sense that those panels are, and remain, closed. These panels L,R,B are closed to the extent that carriers 26 within the bucket cannot pass out of the bucket through those panels; and carriers cannot be passed into the bucket, through those panels.

The top panel T, under panel U, and front panel F of the bucket 29 can be opened and closed, and are designated herein as open/closable panels of the bucket. Each of the open/closable panels includes left and right operable doors 30TL,30TR; 30UL,30UR; 30FL,30FR (being referenced 30 collectively). The pair of doors 30 that comprises one of the panels of the bucket can be operated to an open position, in which that panel of the bucket is open enough to let the box 24 (and the carriers 26 inside the box) pass in or out of the bucket through that panel; and the doors can be operated to a closed position, in which that panel is closed enough to prevent a box and carriers within the bucket from passing out of the bucket, through that panel.

It may be noted-that none of the panels of the bucket 29 is open, in the sense that the panel cannot be operated to a closed condition.

The pairs of doors 30 are opened and closed by means of rams, which are indicated diagrammatically by the motion arrows 32F,32U,32T. The opening and closing of the doors is under the control of a computer, or operations-controller, of the apparatus.

The bucket 29 is mounted in a bucket-cradle 34. The bucket is pivotable-about a pivot axis 35, by operation of a pivot-motor 36, with respect to the bucket-cradle 34; but apart from that, the bucket is constrained against movement in all modes relative to the bucket-cradle. The pivot-axis 35 lies on a line that is parallel to the plane of the carriers 26 in the senior box 24S, and runs through the side panels L,R of the bucket 29.

The bucket-cradle 34 is mounted for up/down sliding on a bucket-elevator 37. The bucket-elevator includes a tower 38, fixed to the frame of the apparatus, and having a guide-track comprising two pillars 39. The bucket-cradle 34 is fitted with corresponding guide-slippers 40, whereby the bucket-cradle can slide up/down with respect to the tower 38 of the bucket-elevator, but cannot move in any other mode relative to the tower. The bucket-cradle is driven up/down the bucket-elevator by means of a cable and pulley arrangement 42, powered by an elevator-motor 43.

The apparatus includes a magazine 45, in which the carriers are assembled prior to being picked off, one by one, by a carrier-picker, and fed into the packaging machine (not shown). The magazine 45 as shown in FIG. 1 is arranged in a carriers-upright-in-a-row configuration, in that the carriers are standing upright, on their edges, in the magazine. The carrier-picker (not shown) lies at the left end of the magazine, and the carriers may be urged gently in that direction by a weight system, similar to that shown in FIG. 4 of '707. Alternatively, as here, the magazine includes a magazine-ram 46, which applies a gentle load, pressing the row of carriers to the left, against the carrier-picker. Of course, the magazine-ram 46 has to be withdrawn, in order to create a space into which the fresh batch of carriers can be inserted.

When a sensor (not shown) detects that the magazine needs replenishing, a finger or hook 47 is actuated, which holds the top edge of the last carrier. (There is a corresponding actuable hook (not shown) in the platform 48 of the magazine 45, which holds the bottom edge of the last carrier.) A row of a hundred, or a few hundred, carriers arranged in the magazine is quite resilient, whereby, without the hook 47, the row would expand and ease back along the magazine (i.e to the right) a considerable distance. With the hooks holding the row against the carrier picker, the force of the row on the carrier-picker can remain more or less constant for at least several seconds, despite the removal of carriers at the rate of say one per second, by the picker.

Thus, for replenishment, the hook 47 is actuated, and the magazine-ram 46 withdrawn, after which there is a period of at least a few seconds in which to drop the fresh batch of carriers onto the platform of the magazine. Then, the magazine-ram 46 is urged forwards once more, and the hook 47 is released, and the picking continues.

Figure 2:
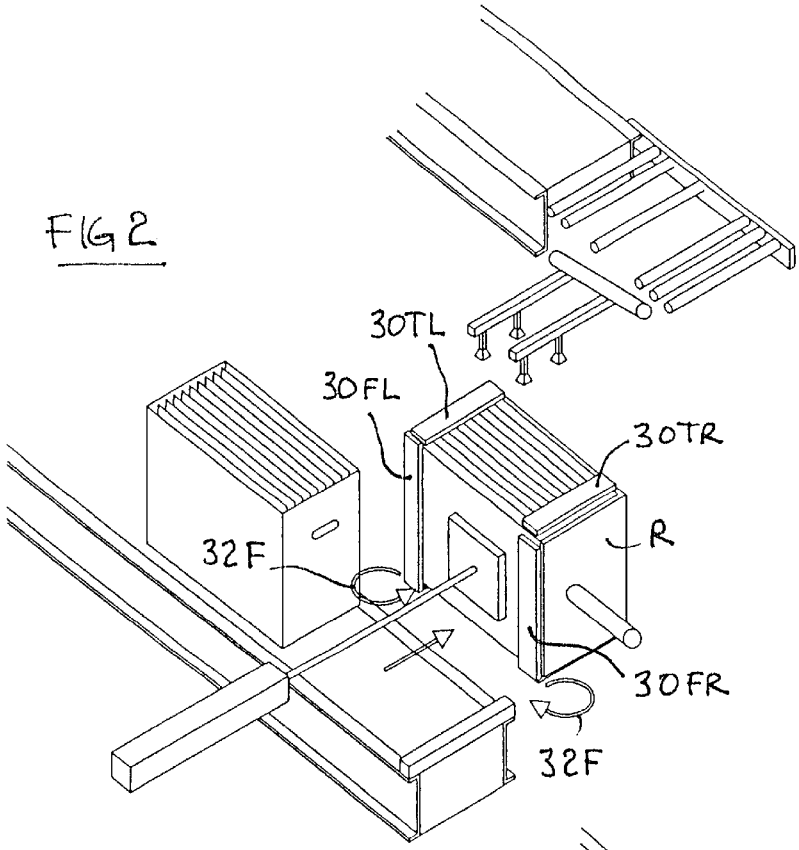
FIG. 2 is the same view as FIG. 1 of the apparatus of FIG. 1, in the same position as FIG. 1, but omitting some of the components of the apparatus.
Figure 3:
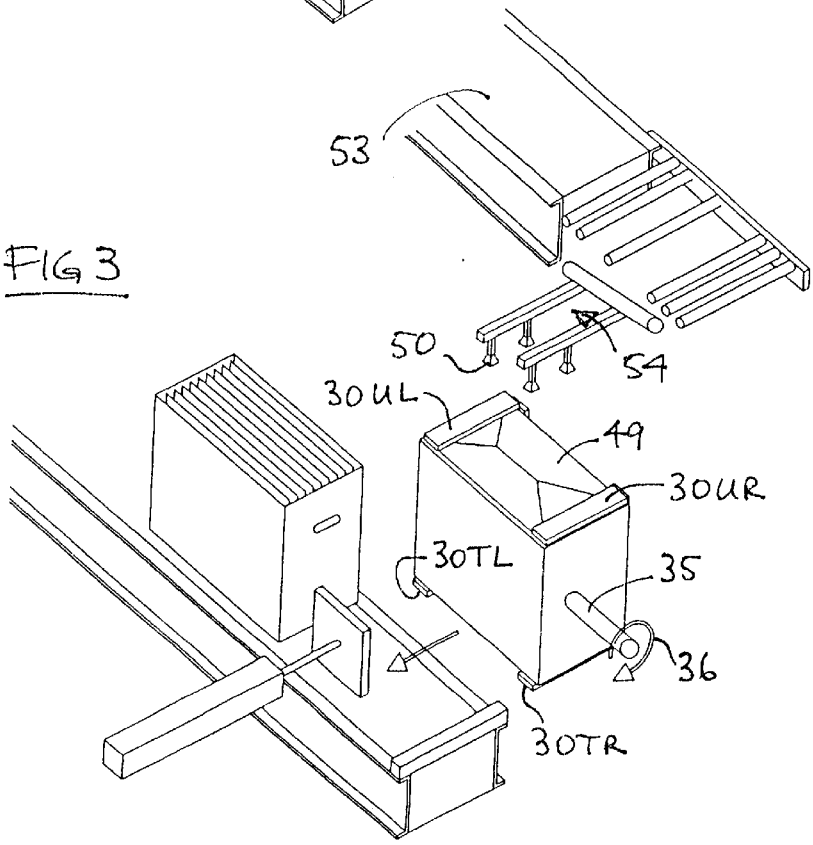
FIG. 3 is the same view as FIG. 2, but shows the apparatus at a later stage of operation.

The sequence of operations may be described as follows. FIG. 2 shows the box-motor 28 being actuated, to drive the senior box into the bucket, through the opened front panel F of the bucket. Then, the front panel F is closed by actuation of the front-motor 32F. Next, FIG. 3, the pivot-motor 36 is actuated, to invert the bucket. Next, FIG. 4, the under-panel U of the bucket, now of course facing upwards, is opened, by actuation of the under-motor 32U.

Figure 5:
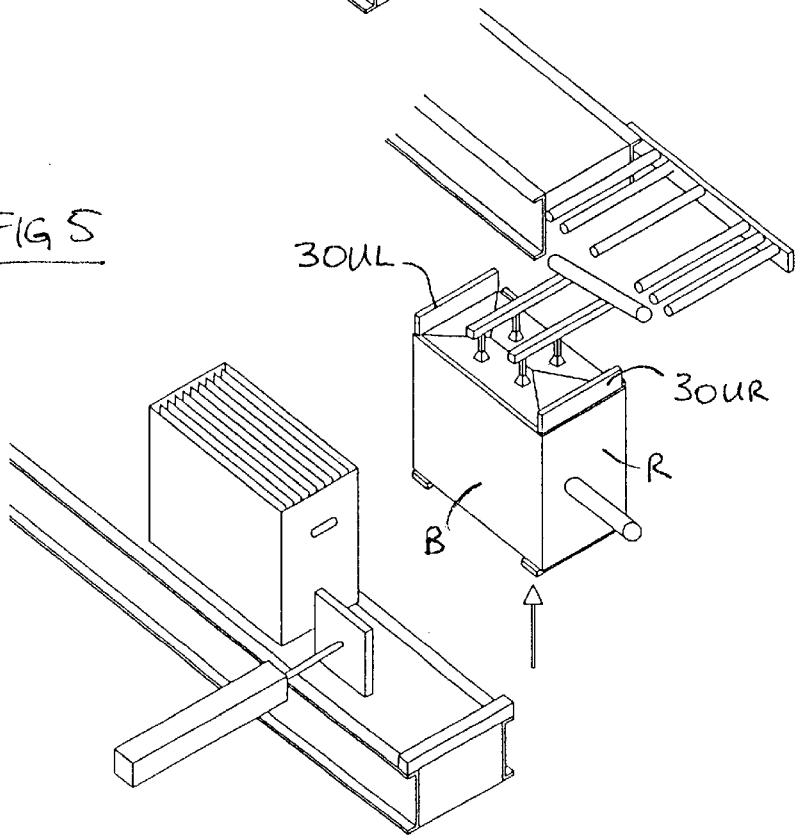
FIG. 5 is the same view as FIG. 2, but shows the apparatus at a later stage of operation.

Next, FIG. 5, the elevator-motor 43 is actuated, to raise the bucket 29, until the floor 49 of the box 24S (which is also now facing upwards) makes contact with the vacuum cups 50. The cups snag the floor 49 of the box, whereby, when the bucket-elevator is now lowered, FIG. 6, the bucket descends, and the box 24S is left attached to the box-lift-off-head 52.

Preferably, the under-panel U (which is still on top of the bucket), and the other open/closable panels of the bucket, should all be closed during the descent of the bucket in the bucket-elevator, to keep the carriers firmly in place in the bucket, just in case the movement of the bucket might be jerky.

Also, in FIG. 6, the hook 47 has been activated, and the magazine-ram 46 has been withdrawn, to create a space on the magazine 45 for receiving the batch of carriers contained in the bucket 29. FIG. 6*a* is the same as FIG. 6, but includes the bucket-elevator. FIG. 7 shows the bucket fully lowered onto the platform. The top panel T of the bucket (now underneath) is opened, by activating the top-motor 32T.

The internal width of the bucket 29 is W cm wide, which is clear over the dimension D cm of the carriers. The gap G cm between the closed doors that comprise the top panel T is larger than W, whereby the doors of the top-panel can remain closed until the bucket is actually resting against the platform 48 of the magazine. Thus, the carriers can be lowered gently onto the platform, rather than being dropped onto the platform, which might cause misalignments etc.

It may be noted that the doors 30 are small, in relation to the size of the bucket. The doors do not need to be large to contain and support the carriers within the bucket. Small doors have the benefit that only a small arc of movement needs to be accommodated; and small doors can be moved with small pneumatic actuators.

FIG. 7 also shows the transfer of the empty box onto the empty-box-conveyor 53. The box-lift-off-head 52 is carried on a lever-arm 54, which is operated by a swing-lever-motor 56. The box-lift-off-head pivots between the box-snagging position (FIG. 6) and the box-discharge position (FIG. 7).

FIG. 8 shows the magazine 45 now replenished, the hook 47 withdrawn, the magazine-ram 46 back in position, the empty box 24S being disposed of on the empty-box-conveyor 53, and the bucket 29 being raised in the bucket-elevator 37, ready to take on a further box of carriers.

One major benefit of the use of the bucket-elevator, in the apparatus as shown, is that the two box conveyors 23,53 are up out of the way, above the magazine, and above the packaging machine. The designer usually prefers to locate the magazine at a comfortable working height for the assembly line setters and other workers. Space is at a premium at that height, and the fact that the box conveyors can be above the magazine, because of the elevator, frees up space in this premium area.

Also, the box conveyors and associated rams and motors, etc, can be a safety hazard, both to setters and operatives, whereby, again, placing the conveyors way above the magazine (as is permitted by the use of the bucket-elevator), gives a safety advantage.

The apparatus as described is versatile as to its manner of use. As shown, the full-box-conveyor 23 and the magazine 45 are so disposed that the plane of the carriers 26 as they lie in the senior box is parallel to the plane of the carriers as they lie in the magazine. The carriers might be the same way up in the magazine as they were in the senior box; where that is the case, the bucket is inverted once prior to the box being extracted from the bucket, and then the bucket (with carriers inside) is inverted again, or re-inverted, on the way down in the bucket-elevator, before the carriers are deposited in the magazine.

Sometimes, the boxes are delivered with the carriers upside down in the box, relative to the position in which the carriers are to be deposited in the magazine. In that case, the second inversion or re-inversion of the bucket can be omitted.

In some cases, the boxes of carriers are delivered onto the junior end of the full-box-conveyor upside down, i.e the boxes travel along the full-box-conveyor with the floor of the box on top. In that case, the box can be extracted out of the top side of the bucket, without the bucket needing to be inverted. However, the apparatus is intended to cater for the more usual case, where the boxes on the full-box-conveyor are right side up, as shown.

As mentioned, the magazine shown in FIG. 1 is in the carriers-upright-in-a-row configuration. As shown in FIGS. 8,9 of '707, the magazine may be arranged in a carriers-flat-in-a-column configuration. The apparatus as shown herein can be applied to such a magazine, in which case it will be understood that the bucket should be rotated through 90 degrees in order for the carriers to be presented correctly for deposition in such magazine.

Figure 4:
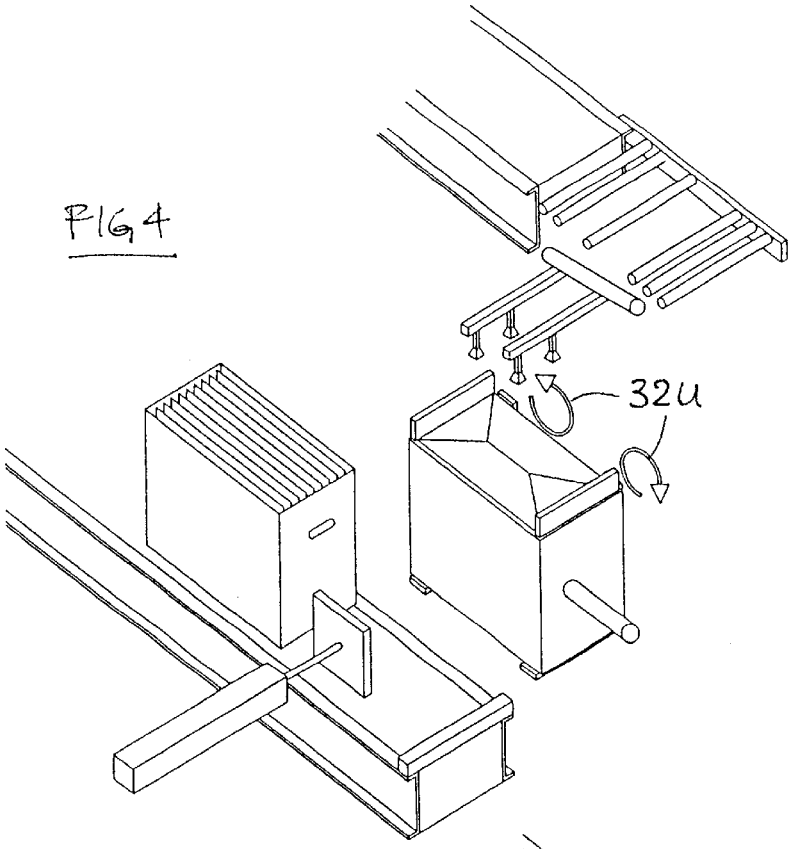
FIG. 4 is the same view as FIG. 2, but shows the apparatus at a later stage of operation.

When the magazine is in the carriers-upright-in-a-row configuration, the platform of the magazine need not be horizontal, but might be inclined at a (small) angle to the horizontal (as in FIG. 4 of '707). In that case, the operations-controller can be programmed to rotate the bucket, as it descends in the bucket-elevator, to that same angle, to ensure trouble-free deposition.

As shown, the line of the pivot-axis 35 of the bucket 29, relative to the bucket-cradle 34, passes through the bucket from left to right, and lies within the extent of the side panels L,R of the bucket. The designer may rather prefer to align the pivot-axis to pass through the bucket from front to back. In that case, some motions that are possible with the left/right pivot-axis would be ruled out, but others would be enabled. In some cases, it might be appropriate for the boxes of carriers to reside on the full-box-conveyor with the carriers aligned at right angles to the longitudinal axis of the conveyor, rather than in line with the conveyor—in which case pivoting the bucket front-back rather than left-right, might be more convenient.

In order for the bucket to be rotated in the motions required in the apparatus, the pivot axis should be horizontal. If the pivot axis were e.g vertical, the bucket could not be inverted in the required manner.

Preferably, the panels of the bucket are made adjustable. The adjustment settings may be left entirely to the operator, but there might be a danger, then, that the bucket might be adjusted too tightly onto the shipping boxes, or not tightly enough, and it is preferred that the apparatus have a number of pre-determined configurations of the bucket, whereby the operator can quickly adjust the bucket to the configuration appropriate to the incoming carriers.

As shown, the frame of the apparatus is self-supporting, and can be regarded as a separate structure from the box conveyors. The carrier magazine is often built into the packaging machine, as a component thereof, rather than as a component of the present apparatus, and so the present apparatus should be designed so it can be fine-adjusted to the particular height, orientation, etc of the magazine that already exists in the packaging machine. The designer should aim to set the apparatus primarily to the magazine, and then install the full and empty box conveyors to suitable heights and orientations. However, some adjustment as to heights etc can be accommodated by control settings of the bucket-elevator and other components in the apparatus.

The presence of the bucket-elevator, which permits the conveyors to be overhead, i.e well out of the way of the magazine, confers the further advantage that the apparatus can be installed on most configurations of packaging-machine and magazine likely to be encountered.

What is claimed is:

1. Apparatus for unpacking boxes of carriers, which includes:

a fixed frame, a full-box-conveyor, an empty-box-conveyor, and a magazine;

wherein the full-box-conveyor holds a quantity of full boxes, the boxes containing respective batches of the carriers;

a bucket, having front, back, left, right, top, and bottom panels;

wherein some of the panels of the bucket are open/closable panels;

wherein the front panel is one of the open/closable panels of the bucket, and the apparatus includes an operable front-motor which, when operated, opens and closes the front panel of the bucket;

an operable box-motor, which, when operated, drives one of the boxes occupying a senior position on the full-box-conveyor, with its batch of carriers contained therein, off the full-box-conveyor, and into the bucket, through the front panel of the bucket;

a bucket-cradle, in which the bucket is guided for pivoting movement about a bucket-axis in the bucket-cradle;

an operable pivot-motor, which, when operated, rotates the bucket about the bucket-axis relative to the bucket-cradle;

the bucket-cradle includes motion-constraints, which are so structured that the bucket cannot move relative to the bucket-cradle in any mode other than pivoting about the said bucket-axis;

an operable box-extractor, which, when operated, extracts the box from the bucket, leaving the batch of carriers remaining in the bucket, and deposits the extracted box on the empty-box-conveyor;

a bucket-elevator, which guides the bucket-cradle for bodily up/down motion of the bucket-cradle, relative to the frame of the apparatus;

and an operable elevator-motor, which, when operated, drives the bucket-cradle for up/down motion relative to the frame of the apparatus.

2. Apparatus of claim 1, wherein the apparatus includes an operations-controller, which is programmed to carry out the following operations:

to operate the elevator-motor and the pivot-motor until the bucket lies in position and orientation to receive the senior box from the full-box-elevator;

to operate the front-motor, thereby opening the front panel of the bucket;

to operate the box-motor, thereby driving that box into the bucket;

to operate the front-motor, thereby closing the front panel of the bucket;

to operate the box-extractor, thereby extracting the box up out of the bucket and depositing the extracted box on the empty-box-conveyor, leaving the batch of carriers in the bucket;

to operate to closed positions those of the open/closable panels of the bucket that are necessary to prevent the carriers in the bucket from passing out of the bucket;

to operate the elevator-motor, thereby lowering the bucket, with the carriers closed therewithin, in the bucket-cradle, downwards in the elevator, to the magazine;

to operate to open positions those of the open/closable panels of the bucket that are necessary to enable the carriers in the bucket to pass out of the bucket into the magazine;

and to transfer the batch of carriers to the magazine, from the bucket.

3. Apparatus of claim 1, wherein the top panel of the bucket is one of the open/closable panels of the bucket, and the apparatus includes an operable top-motor which, when operated, opens and closes the top panel of the bucket.

4. Apparatus of claim 1, wherein the bottom panel of the bucket is one of the open/closable panels of the bucket, and the apparatus includes an operable bottom-motor which, when operated, opens and closes the bottom panel of the bucket.

5. Apparatus of claim 2, wherein:

the bottom panel of the bucket is one of the open/closable panels of the bucket, and the apparatus includes an operable bottom-motor which, when operated, opens and closes the bottom panel of the bucket;

the operations-controller is programmed to carry out the following operation:

after operating the elevator-motor to lower the bucket to the magazine, to operate the bottom-motor, enabling the carriers to pass from the bucket downwards into the magazine.

6. Apparatus of claim 1, wherein the left and right panels of the bucket are solid, each of those panels being so structured as to prevent the passing of the box, or of the carriers, into or out of the bucket through that panel.

7. Apparatus of claim 6, wherein:

the open/closable panels of the bucket comprise respective pairs of left and right hinged doors, which are hinged respectively from the solid left and right panels of the bucket;

the left and right doors, when closed, occupy only a small marginal area of the open/closable panel, contiguous respectively with the left and right panels.

8. Apparatus of claim 1, wherein:

the magazine is arranged in a carriers-upright-in-a-row configuration;

the magazine includes a platform on which the carriers are supported;

the platform has a width W, and the carriers have a dimension D as measured in the direction across the width of the platform;

the width W of the platform is shorter than the dimension D of the carriers, whereby ends of the carriers protrude beyond the edges of the platform;

the bucket is wider, internally, between the left and right panels, than the dimension D of the carriers;

in respect of each of the open/closable panels:

when the left and right doors are closed, they do not fill the whole panel, but leave a gap G between the doors;

and the gap G between the closed doors is larger than the width W of the platform of the magazine.

9. Apparatus of claim 2, wherein:

the senior box, in the senior position on the full-box-conveyor, containing the batch of carriers, has a bottom panel, which closes off the bottom of the senior box;

the box-extractor includes an operable box-lift-off-head, which, when operated, and when contacted by the bottom panel, snags the bottom panel of the box;

the operations-controller is programmed to carry out the following operations, after the box of carriers has been placed inside the bucket, and the bucket has been inverted, and the bottom panel of the bucket, now facing upwards, has been opened:

to bring the bottom panel of the box in the bucket into contact with the box-lift-off-head;

to operate the box-lift-off-head, thereby snagging the box thereto;

to operate the elevator-motor, thereby lowering the bucket;

and the arrangement of the apparatus is such that the carriers remain with the bucket as the bucket is lowered in the bucket-elevator, and the box remains with the box-lift-off-head.

10. Apparatus of claim 9, wherein:

the box-lift-off-head is mounted on a swing-lever, which is pivoted to the fixed frame;

the swing-lever is pivotable between a box-snagging position and a box-discharge position;

in the box-snagging position of the swing-lever, the box-lift-off-head is in position to snag the box from the bucket;

and in the box-discharge position, the box-lift-off-head is in position to deposit the box onto the empty-box-conveyor;

the box-extractor includes an operable swing-lever-motor, which, when operated, pivots the swing-lever between the said positions;

and the operations-controller is programmed to carry out the following operation, after the bucket, containing the batch of carriers, has been lowered away, on the elevator, from the extracted box:

to operate the swing-lever-motor, thereby transferring the extracted empty box onto the empty-box-conveyor.

11. Apparatus of claim 1, wherein the bucket-elevator includes a bucket-guide for constraining and guiding the said up/down motion of the bucket-cradle, the path to which the bucket-cradle is constrained being termed the bucket-path.

12. Apparatus of claim 11, wherein:

the bucket-elevator includes a guide-slipper, which is fixed to the bucket-cradle;

the bucket-elevator includes a guide-track, which is fixed to the frame of the apparatus;

the apparatus is so structured that the guide-slipper is constrained to slide along the guide-track;

and the apparatus is so structured that the bucket-path is a straight line.

13. Apparatus of claim 12, wherein the bucket-path is substantially vertical.

14. Apparatus of claim 6, wherein the pivot axis runs through the left and right panels of the bucket.

15. Apparatus of claim 1, wherein the bucket is rotatable about a pivot-axis, relative to the bucket-cradle, and the pivot-axis lies in a horizontal plane in all positions of the bucket on the bucket-elevator.

16. Apparatus of claim 1, wherein:

the magazine is arranged in a carriers-upright-in-a-row configuration;

the plane of the carriers as they lie in the senior box on the full-box-conveyor is aligned along a horizontal line in a direction A;

and the arrangement of the apparatus is such that the plane of the carriers as they lie in the magazine is aligned along a horizontal line that is parallel to the direction A.

17. Apparatus of claim 16, wherein the direction A is parallel to the longitudinal axis of the full-box-conveyor.

18. Apparatus of claim 1, wherein the carriers comprise cardboard carriers for carrying respective vendible packs of receptacles of liquid, for example cans of soft drinks or bottles of beer.

* * * * *